US008990021B2

(12) United States Patent
Jeffryes

(10) Patent No.: US 8,990,021 B2
(45) Date of Patent: Mar. 24, 2015

(54) DRILLING DYNAMICS

(75) Inventor: Benjamin Jeffryes, Histon (GB)

(73) Assignee: Schlumberger Technology Corporation, Cambridge, MA (US)

( * ) Notice: Subject to any disclaimer, the term of this patent is extended or adjusted under 35 U.S.C. 154(b) by 538 days.

(21) Appl. No.: 13/141,423

(22) PCT Filed: Nov. 4, 2009

(86) PCT No.: PCT/IB2009/007477

§ 371 (c)(1),
(2), (4) Date: Aug. 25, 2011

(87) PCT Pub. No.: WO2010/079379

PCT Pub. Date: Jul. 15, 2010

(65) Prior Publication Data

US 2011/0301924 A1 Dec. 8, 2011

(30) Foreign Application Priority Data

Jan. 8, 2009 (GB) ..... 0900229.6

(51) Int. Cl.
*G06F 19/00* (2011.01)
*E21B 47/00* (2012.01)
*E21B 44/00* (2006.01)

(52) U.S. Cl.
CPC ..... *E21B 44/00* (2013.01)
USPC ..... 702/9; 73/152.49

(58) Field of Classification Search
USPC ..... 702/9, 1–2, 6, 11–14, 33, 41–43, 81, 702/84–85, 90, 96, 98–100, 105, 127, 138, 702/140, 142, 145, 147, 182–183, 189; 703/2, 5, 7, 10; 700/28–29, 31; 175/46, 175/48, 50, 56; 73/152.43, 152.46–152.49
See application file for complete search history.

(56) References Cited

U.S. PATENT DOCUMENTS

| | | | |
|---|---|---|---|
| 4,760,735 | A | 8/1988 | Sheppard et al. |
| 5,844,132 | A | 12/1998 | Fabret et al. |
| 6,732,052 | B2 | 5/2004 | MacDonald et al. |
| 7,085,696 | B2 | 8/2006 | King |

FOREIGN PATENT DOCUMENTS

| | | |
|---|---|---|
| EP | 0263644 A2 | 4/1988 |
| EP | 0263644 A3 | 2/1989 |

OTHER PUBLICATIONS

Canudas-de-Wit et al., D-OSKIL: A New Mechanism for Controlling Stick-Slip Oscillations in Oil Well Drillstrings, Nov. 2008, IEEE Transactions on Control Systems Technology, vol. 16, No. 6, pp. 1177-1191.*

Li et al., A Steady Tension-Torque Model for Drillstring in Horizontal Wells, 1993, Society of Petroleum Engineers 26295, 8 pp.*

(Continued)

*Primary Examiner* — Toan Le

(57) ABSTRACT

A method of determining movement dynamics of a drillstring is provided that includes the steps of calculating or measuring a friction coefficient for the sliding contact between the drillstring and the sidewall of a borehole, the friction coefficient being a varying function of non-zero sliding velocities; and predicting movement dynamics of the drillstring using the measured friction coefficient.

16 Claims, 9 Drawing Sheets

(56) References Cited

OTHER PUBLICATIONS

Briscoe et al: "Lubrication of water-based clay suspensions", Tribology Research: From Model Experiment to Industrial Problem, G. Dalmaz et al (Editors), Elsevier Science, 2001, pp. 331-340.
Chatterjee: "Time-delayed feedback control of friction-induced instability", International Journal of Non-Linear Mechanics, vol. 42, 2007, pp. 1127-1143.
Mihajlović et al: "Friction-induced vibrations in an experimental drill-string system for various friction situations", ENOC-2005 (European Nonlinear Oscillations Conference), Eindhoven, Netherlands, Aug. 7-12, 2005.
Mihajlović et al: "Friction-induced torsional vibrations in an experimental drill-string system", Eindhoven University of Technology, Department of Mechanical Engineering, Dynamics and Control Group. Proceedings of the 23rd IASTED International Conference on Modelling, Identification and Control, Feb. 23-25, 2004, Grindelwald, Switzerland. Editor M.H. Hamza, Anaheim, Acta Press, 2004.
Navarro-López et al: "Modelling and analysis of stick-slip behaviour in a drillstring under dry friction", Congreso Anual AMCA 2004 (Asociación de México de Control Automático), Oct. 20-21, 2004, ISBN: 970-32-2137-8, pp. 330-335.
Quigley et al: "A full-scale wellbore friction simulator", 1990 IADC/SPE Drilling Conference. Houston, Texas, Feb. 27 to Mar. 2, 1990, IADC/SPE 19958.
Stribeck: "Die Wesentlichen Eigenschaften der Gleit- und Rollenlage", Z Verein, Deut. Ing, vol. 46, No. 36, 1902, pp. 1341-1348. Full translation provided: "The essential properties of friction bearings and roller bearings", Journal of the Association of German Engineers.
Van De Velde et al: "The friction force during stick-slip with velocity reversal", Wear, vol. 216, No. 2, 1998, pp. 138-149.
Combined Search and Examination Report of British Application No. GB 0900229.6 (57.0878 GB NP) dated Apr. 7, 2009.
International Search Report of PCT Application No. PCT/IB2009/007477 (57.0878 WO PCT) dated May 28, 2010.

* cited by examiner

DRILLING DYNAMICS

FIELD

Embodiments of the present invention relate to a method of determining, modeling, managing and/or correcting movement dynamics of a drillstring, and particularly a method which uses a friction coefficient for the sliding contact between a drillstring and the sidewall of a borehole.

BACKGROUND

During the drilling of subterranean boreholes, high levels of rotational oscillation of the drillstring may occur; the drillstring going through cycles of rotational acceleration and deceleration. In some situations this can lead to "stick-slip" occurring, in which the bit or portions of the drillstring are at rest or even turn backwards.

These oscillations can be influenced by the choice of drill bit and the force and rotation speed applied to the drill bit. The generation of these oscillations has been attributed to a rotational force acting on the bit that reduces with increased rotation speed.

However, "stick-slip" oscillations have also been observed in drillstrings when rotating off-bottom, for example while running into hole. This is generally a feature of wells in which a substantial portion of the borehole is either horizontal or near-horizontal (also known as high-angle wells). It has been empirically determined that the oscillations become more severe as the hole lengthens and as the torque required to rotate the drillstring increases.

While observationally it may be seen that "friction" of some kind is a contributory agent in generating rotational oscillations, it has not previously been determined what properties of the frictional interaction are necessary for the generation of rotational oscillations, or how they may be interpreted, measured or estimated.

Nonetheless, it is often necessary to estimate and measure frictional parameters for use in the planning, simulation and monitoring of wells, especially those that deviate substantially from the vertical.

In modelling the torque and drag behaviour of drillstrings, it is conventional to use a Coulomb friction model for the tangential sliding contact between a drillstring and a borehole, i.e. the sliding contact at the sidewall of the borehole, not at the bit face. Such a model uses two friction coefficients (i.e. the model is based on the constant of proportionality between the frictional force and the normal side force): a dynamic friction coefficient for when the drillstring is moving relative to the borehole, and a static friction coefficient for when the drillstring is at rest. The dynamic friction coefficient is constant for changes in the relative velocity between the drillstring and the borehole, while the static friction coefficient is normally higher than the dynamic friction coefficient since the force (or torque) required to set a drillstring into motion is generally higher than that required to keep it in motion. According to this model, the friction coefficient changes instantaneously between the shift from static to the dynamic regime.

In Coulomb friction models for torque and drag, different friction coefficients may be used for tangential motion in different directions, for instance in SPE paper 19958 (M. S. Quigley et al., *A Full-Scale Wellbore Friction Simulator*, presented at IADC/SPE Drilling Conference, Houston, Tex., 27 Feb. to 2 Mar., 1990), significantly different dynamic Coulomb friction coefficients were experimentally measured for axial and rotational motion. In this paper, the variations with velocity direction of dynamic (not static) coefficients were measured.

During the drilling of boreholes with rotation induced at least in part by the rotation of the top of the drillstring, the tangential sliding contact velocity has components both along the axis of the borehole and normal to the axis (in the direction of rotation), however the component in the direction of rotation is normally greatly in excess of the component along the axis of the borehole—and thus, the detail of how the friction coefficient may vary with direction does not play a significant role in the determination of the drillstring dynamics. If the drillstring is not being rotated from the surface, but instead the drillbit is turned by a positive displacement motor close to the bit, or if the drillstring rotation is slow and the axial velocity is large (for instance, during slow reaming in or out of hole), then axial friction may be dominant or significant.

In the planning of wells, the torque necessary to turn the drillstring can be estimated for different values of the friction coefficient, and parameters such as the drillstring elements and the trajectory of the borehole can be adjusted so that for a range of reasonable values of the friction coefficient, the torque necessary to turn the drillstring at surface and drill ahead are within an acceptable range (e.g. below the maximum limit of the drill rig and also below the maximum torque allowable on the tubulars, which form the drillstring). Commonly, different values of friction coefficient are used for portions of the well that are lined with steel casing and the open hole (rock section) portions. It may also be taken into consideration that the friction coefficient in some parts of the well reduces over time due to polishing. For wells drilled in an area where there are existing wells of a similar type, likely values of the friction coefficient may be obtained by comparing observed torques in those wells with those predicted by different friction coefficients, and eliminating those values which are contradicted by observation.

A similar exercise is normally conducted for estimation of drag when the drillstring motion is axial (for instance pulling out of hole or running into hole, or to assess the forces on the drillstring when drilling without axial rotation from surface). As for torque, this modelling exercise can be conducted with a range of friction coefficients, and the drag values obtained with friction coefficients within the normal range can be used to assess whether the drilling operation can be satisfactorily conducted with the equipment available.

During the drilling of wells it is usual to monitor the torque as drilling proceeds, compare it to that expected with different values of the friction coefficient, and to use this to make updated predictions as to the torque required at latter stages of drilling the well. If lubricants are being used to reduce the friction coefficient, then the monitoring of torque and the comparison with the expected torque from different friction coefficients allows the effects of the lubricant to be assessed and the quantity of lubricant in the drilling fluid to be adjusted.

SUMMARY

The present invention was at least partly conceived in view of simulation results which demonstrate that the observed phenomenology of off-bottom rotational oscillations in high-angle wells cannot be reproduced using a Coulomb friction model. For example, once motion of the entire drillstring has been initiated, and with continuous rotation at the top, the simulations predict that the oscillations of the drillstring should reduce until steady rotational motion is obtained. The prediction is the same whether the static friction coefficient is equal to, greater than, or less than the dynamic friction coefficient. However, in practice, steady rotational motion is not necessarily achieved.

In general terms, the present invention applies a friction coefficient for the sliding contact between a drillstring and the sidewall of a borehole, which friction coefficient is a varying function of non-zero sliding velocities.

Thus a first aspect of the present invention provides a method of determining movement dynamics of a drillstring, the method including the steps of:

(a) calculating or measuring a friction coefficient for the sliding contact between a drillstring and the sidewall of a borehole, the friction coefficient being a varying function of non-zero sliding velocities; and (b) predicting movement dynamics of a drillstring (such as the rotational velocity of the drillstring) using a model of drillstring behaviour which includes the measured friction coefficient as a parameter.

Advantageously, by employing a friction coefficient which has such a functional form, the predicted movement dynamics can reproduce those observed in the field.

The friction coefficient may be calculated in step (a), the calculation being performed by fitting a model of drillstring behaviour to in-service measurements obtained from the drillstring while the drillstring is operating in the borehole, the model having said friction coefficient as a directly or indirectly adjustable variable. The friction coefficient calculated in this manner is likely to provide accurate predictions for the drillstring. The method may include the initial step of operating the drillstring to obtain the in-service measurements.

However, alternatively, the friction coefficient may be measured in step (a), the measurement being obtained from a test rig which simulates sliding contact between the drillstring and the sidewall of the borehole. This approach may be adopted, for example, where in-service measurements are not available.

Step (b) may be performed repeatedly for different drillstring operating conditions. For example, the different operating conditions may be obtained by varying one or more modelling parameters selected from the group consisting of drillstring advance rate, drillstring length, drillstring trajectory, drillstring rotational velocity, mean cross-sectional area of the metal in the drillstring pipe, and mean radius squared of the metal in the drillstring pipe. In this way, an optimum or improved set of parameters can be identified which can be used in drilling a borehole.

Indeed, a second aspect of the present invention provides a method of operating a drilling rig which controls a drillstring in a borehole, the method including:

performing the method of the first aspect to identify an operating condition for the drillstring predicted to provide stable movement dynamics; and drilling the borehole under the identified operating condition with the drillstring.

Further, a third aspect of the invention provides a method of operating a drilling rig which controls a drillstring in a borehole, the method including the steps of:

(a) predicting movement dynamics of the drillstring (such as, the rotational velocity of the drillstring) for different drillstring operating conditions, the predictions using a model of drillstring behaviour which includes a friction coefficient for the sliding contact between the drillstring and the sidewall of the borehole, the friction coefficient being a varying function of non-zero sliding velocities;

(b) selecting an operating condition predicted to provide stable movement dynamics; and (c) drilling the borehole with the drillstring under the selected operating condition.

In step (a) the different operating conditions may be obtained by varying one or more modelling parameters selected from the group consisting of drillstring advance rate, drillstring length, drillstring trajectory, drillstring rotational velocity, mean cross-sectional area of the metal in the drillstring pipe, mean radius squared of the metal in the drillstring pipe and the velocity dependency of the friction coefficient.

Where a varied modelling parameter is the velocity dependency of the friction coefficient, different velocity dependencies of the friction coefficient may correspond to different drilling fluids. Thus drilling step (c) can be performed using a drilling fluid selected to provide a desired friction coefficient. The "different drilling fluids" can have gross differences in their constitutions, e.g. oil-based mud versus water-based mud, or can simply be the result of changing the concentration and/or type of additive(s) in a base fluid.

Indeed, the method may further include the initial step of measuring said velocity dependencies for different drilling fluids, in step (a) the different operating conditions may be obtained by varying at least the velocity dependency of the friction coefficient according to the velocity dependencies measured for the drilling fluids, and in step (c) the borehole may be drilled with the drilling fluid corresponding to the selected operating condition. The different drilling fluids may be obtained by changing the concentration and/or type of additive(s) in a base fluid.

In both of the above aspects, the friction coefficient is preferably a smoothly varying function of non-zero sliding velocities.

In both of the above aspects, the friction coefficient typically decreases with increasing sliding velocity for at least a range of non-zero sliding velocities. Particularly when using such a functional form for the friction coefficient, models of drillstring behaviour can simulate movement dynamics observed in the field, such as off-bottom rotational oscillations in high-angle wells.

BRIEF DESCRIPTION OF THE DRAWINGS

Embodiments of the invention will now be described by way of example with reference to the accompanying drawings in which.

DETAILED DESCRIPTION

Figure 1:
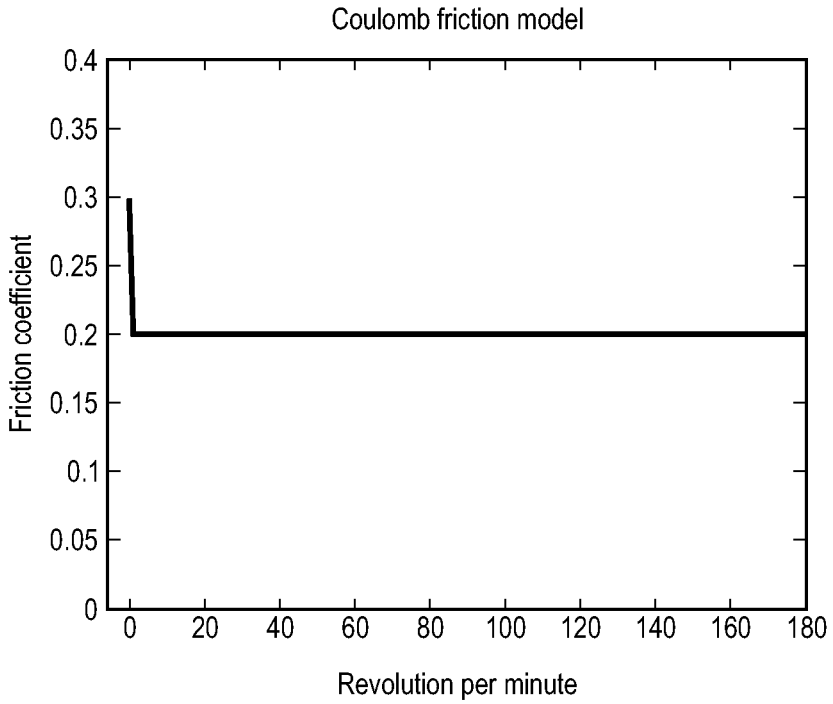
FIG. 1 shows a plot of friction coefficient against revolutions per minute of a drillstring and illustrates a typical Coulomb friction model.

The ensuing description provides exemplary embodiment (s) only, and is not intended to limit the scope, applicability or configuration of the invention. Rather, the ensuing description of the exemplary embodiment(s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

FIG. 1 shows a plot of friction coefficient against revolutions per minute of a drillstring and illustrates a typical Coulomb friction model, having a dynamic friction Coefficient of 0.2 and a static friction coefficient of 0.3, and used conventionally to estimate and measure frictional parameters for use in the planning, simulation and monitoring of wells. R. Stribeck (in *Die Wesentlichen Eigenschaften der Gleit-and Rollenlage*, Z. Verein. Deut. Ing, volume 46, pp 1341-1348, 1902) observed that in oil-lubricated journal bearings the frictional force depends on the velocity, with the friction coefficient declining with velocity for low non-zero velocities. B. J. Briscoe et al. (in *Lubrication of water based clay suspensions*, in "Tribology Research: From Model Experiment to Industrial Problem", G. Dalmaz et al. (ed.), Elsevier Science, pp 331-340, 2001) measured similar behaviour for steel-on-steel contact lubricated by a bentonite based drilling fluid. At higher velocities Stribeck observed the friction increasing, so in addition to a function which declines at low velocities, a term proportional to velocity is normally added.

To define a Stribeck-type friction law, as well as static and dynamic values of the friction coefficient, the functional relationship between velocity (and any other parameters) and the friction coefficient is required. For example, one form that may be used is inverse quadratic:

$$\mu(v) = \mu_{dynamic} + \frac{\mu_{static} - \mu_{dynamic}}{1 + \sigma v^2} + b|v| \tag{1}$$

where v is velocity, $\mu(v)$ is the velocity dependent friction coefficient, $\mu_{dynamic}$ is the dynamic friction coefficient, $\mu_{static}$ is the static friction coefficient, b is the coefficient of the term proportional to velocity, and $\sigma$ is a velocity dependent parameter that determines the slope of the continuous transition from the value of the static friction coefficient to the value of the dynamic friction coefficient as v increases. Another form that may be used is exponential:

$$\mu(v)=\mu_{dynamic}+(\mu_{static}-\mu_{dynamic})\exp(-\log(2)\beta|v|)+b|v| \tag{2}$$

where $\beta$ is a further velocity dependent parameter.

Figure 2:
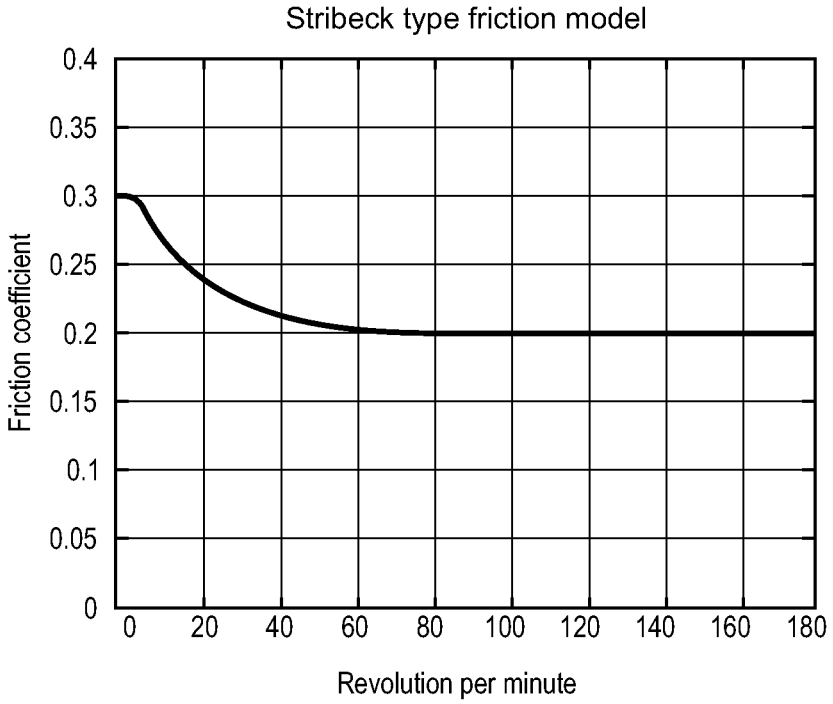
FIG. 2 shows a plot of friction coefficient against revolutions per minute of a drillstring and illustrates a Stribeck-type friction model.
Figure 3A:
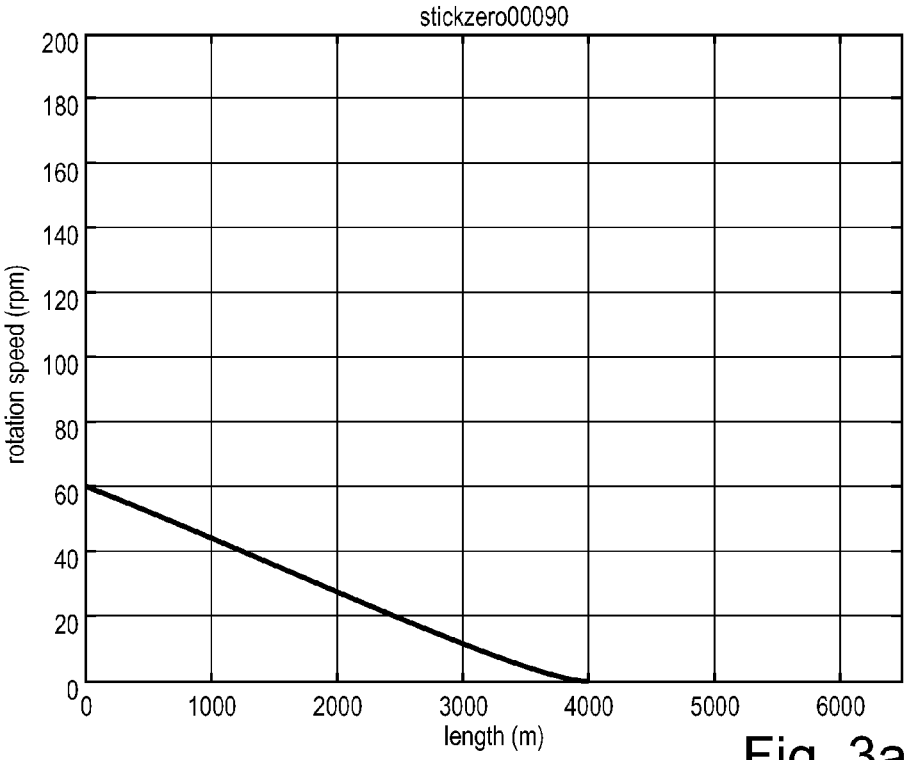
FIGS. 3(*a*) to (*f*) show results for a simulation of a 6000 m long drillstring, using a Coulomb friction model.
Figure 3B:
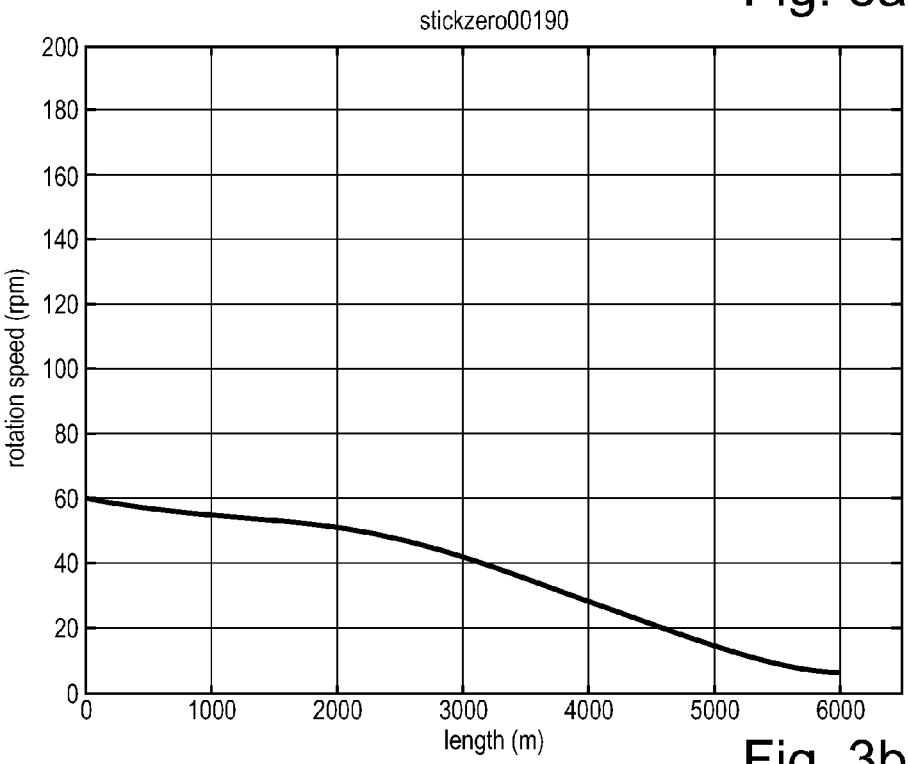
Figure 3C:
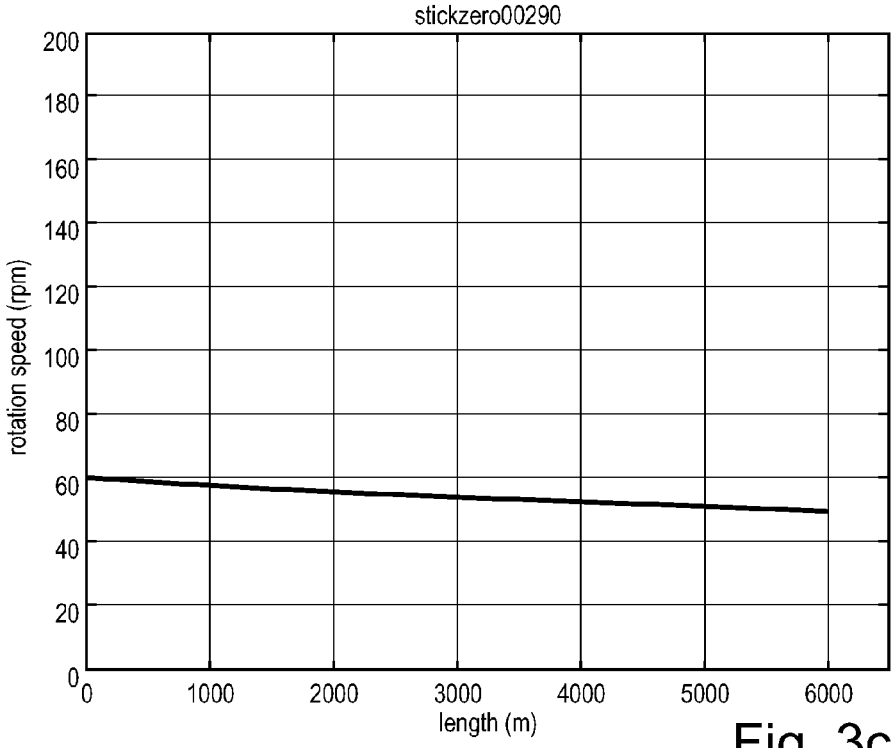
Figure 3D:
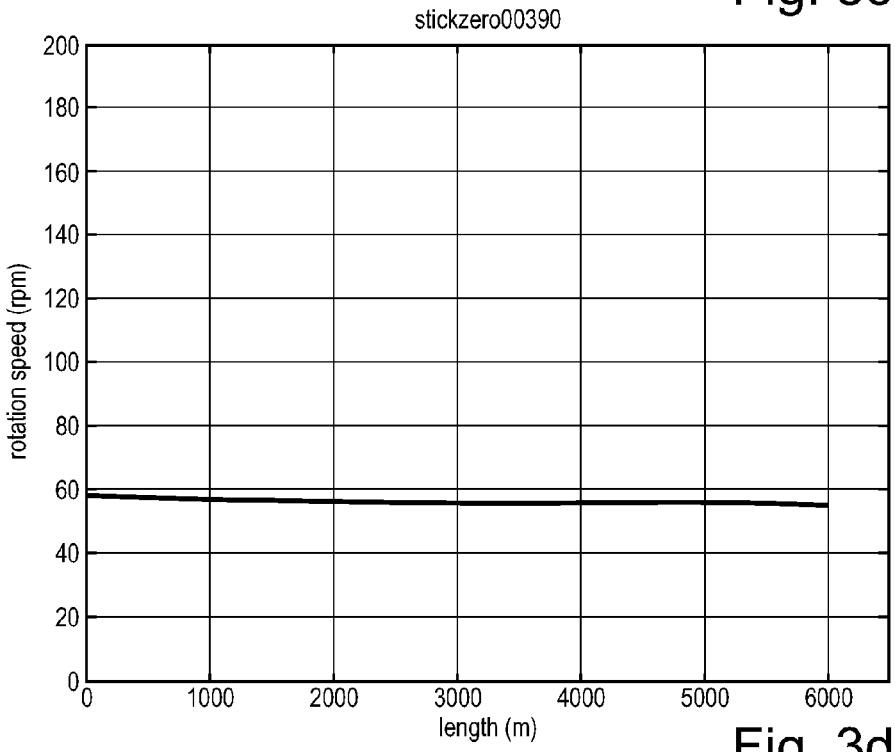
Figure 3E:
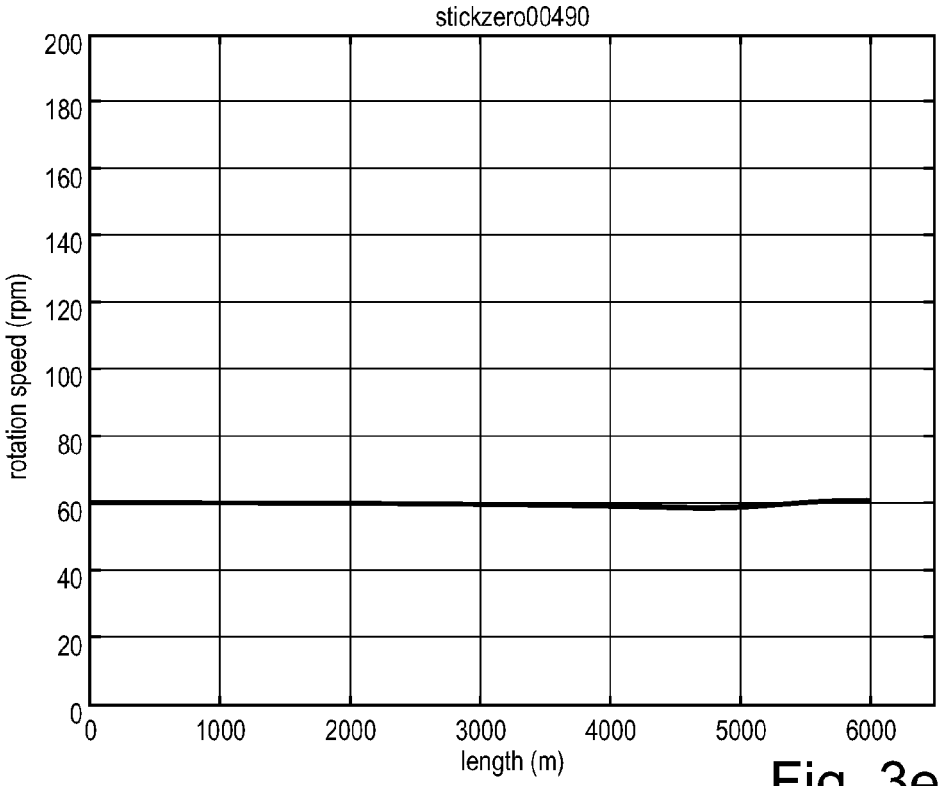
Figure 3F:
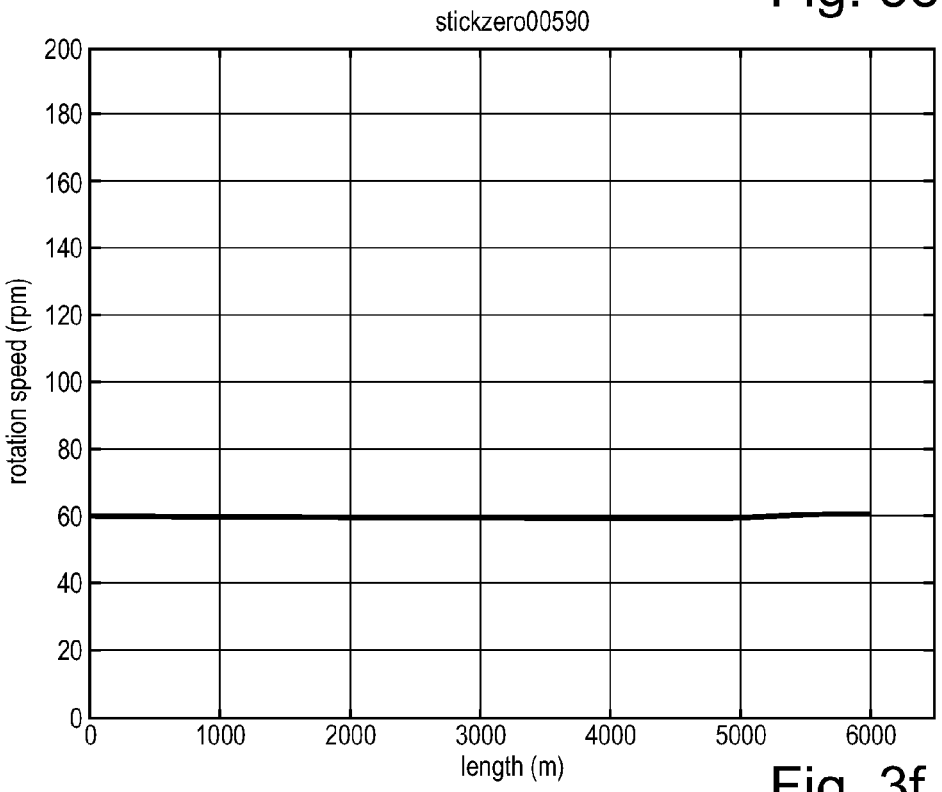
Figure 4A:
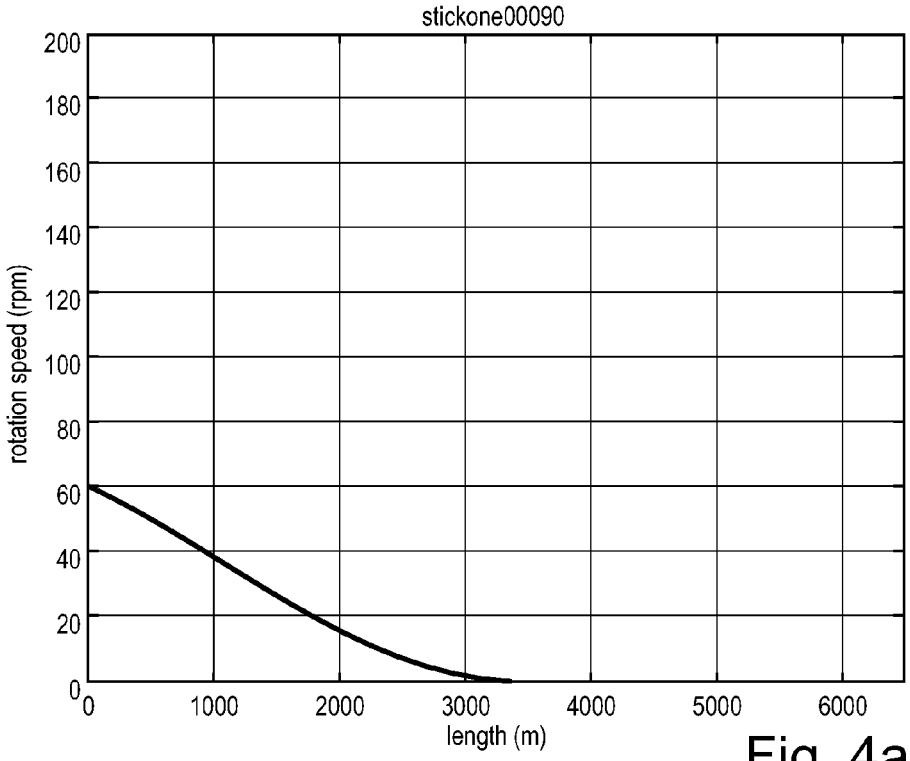
FIGS. 4(*a*) to (*f*) show results for a simulation of a 6000 m long drillstring, using a Stribeck-type friction model.
Figure 4B:
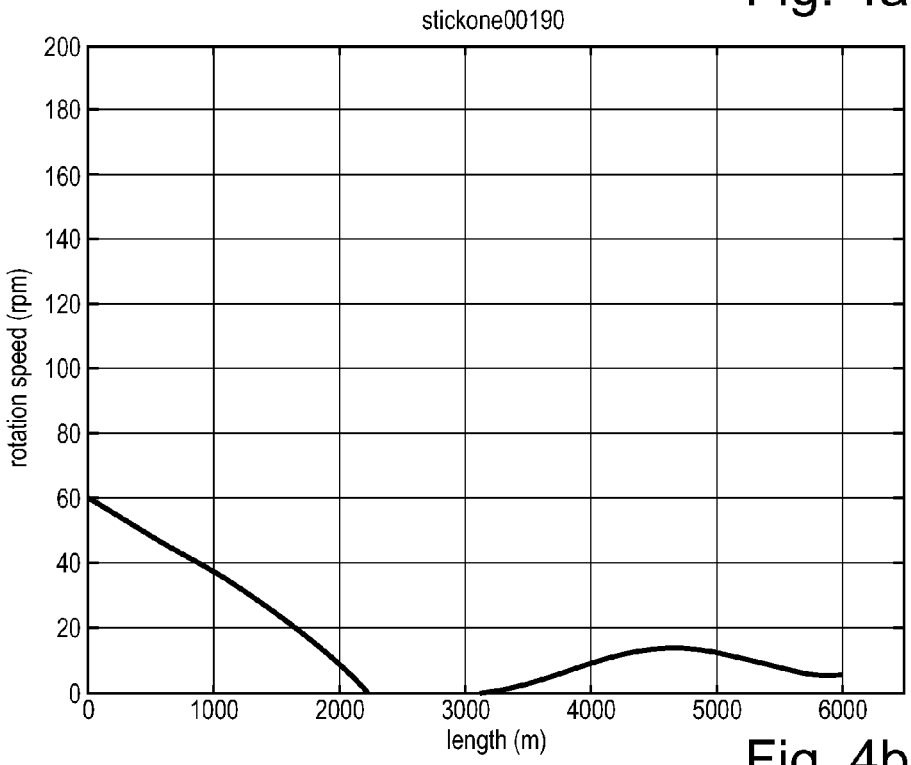
Figure 4C:
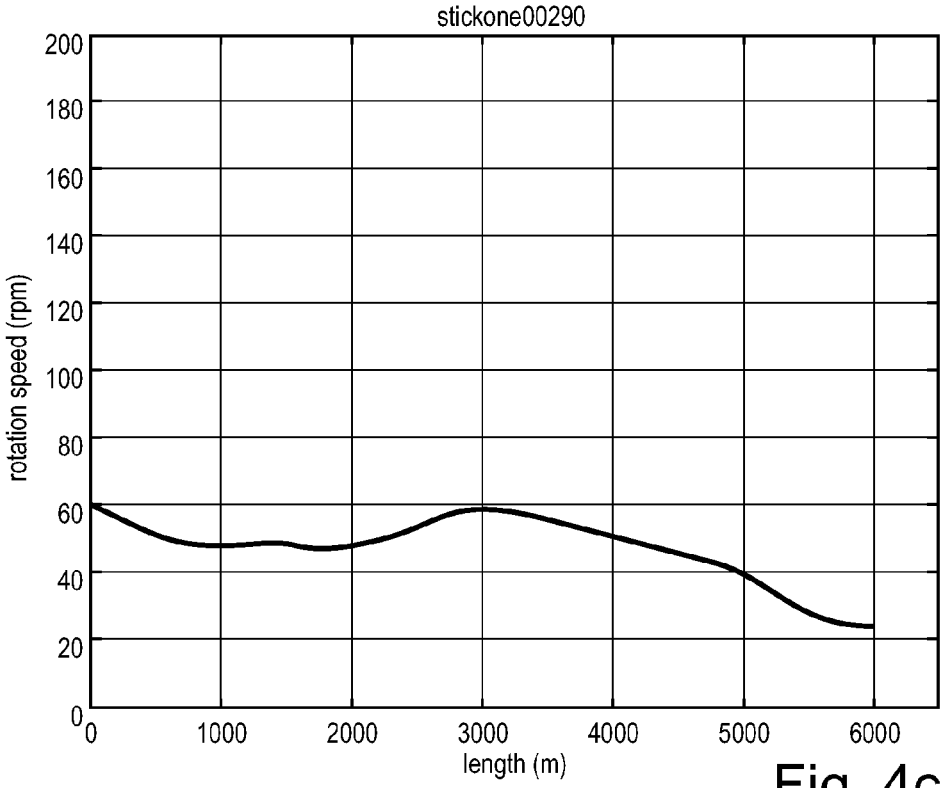
Figure 4D:
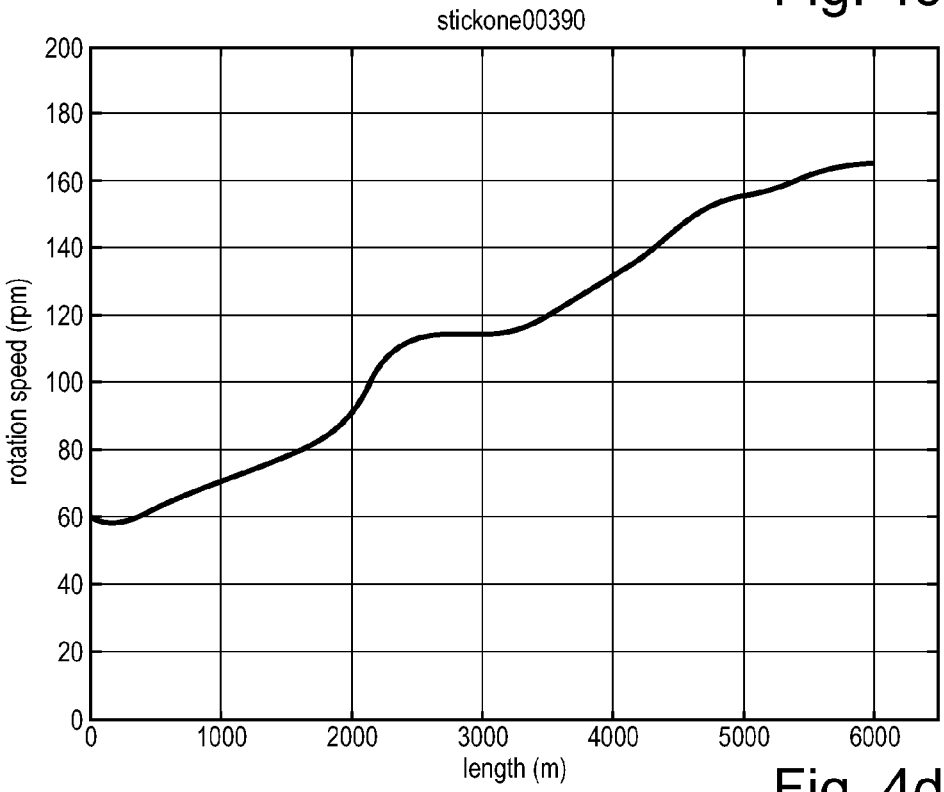
Figure 4E:
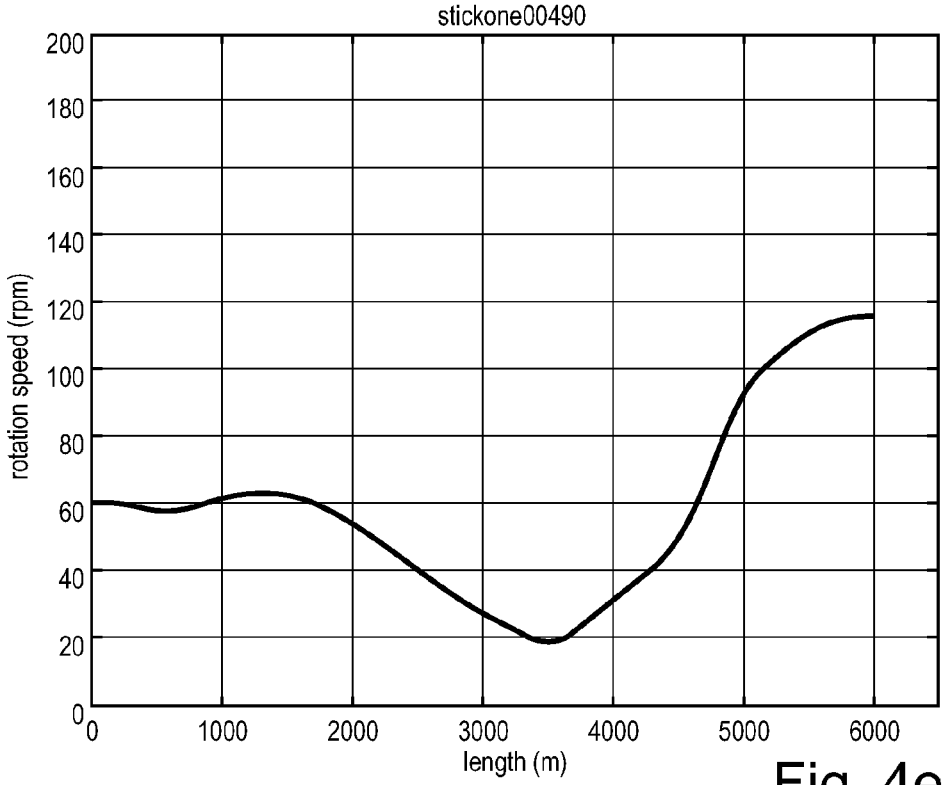
Figure 4F:
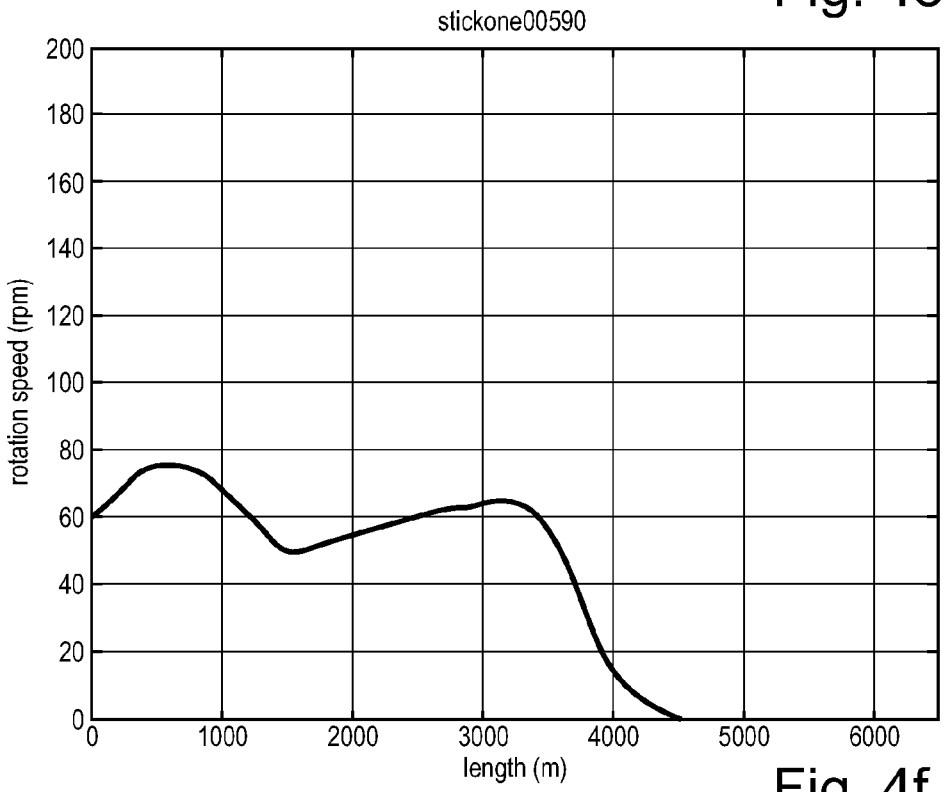

FIG. 2 shows a plot of friction coefficient for the sliding contact between a drillstring and a sidewall of a borehole against revolutions per minute of the drillstring and illustrates a Stribeck-type friction model in which the friction coefficient is a varying function of non-zero sliding velocities. The model has a dynamic friction coefficient $\mu_{dynamic}$ of 0.2 and a static friction $\mu_{static}$ coefficient of 0.3.

Parameters in the Stribeck-type models can vary according to other factors. For instance, the velocity parameter can vary with normal contact stress according to a Herzian contact model, and the static friction coefficient can increase with the time that the drillstring and borehole surfaces have spent at rest with respect to one another.

A model simulating a drillstring in a borehole was developed. The simulation solves coupled sets of partial differential equations modelling the propagation of axial and rotational waves, each of the form:

$$m\frac{\partial v}{\partial t} = \frac{\partial F}{\partial x} \qquad \lambda\frac{\partial F}{\partial t} = \frac{\partial v}{\partial x} \tag{3}$$

where x is the distance along the drillstring, t is the time, F is axial stress for the axial waves and the rotational stress for rotational waves, m is the mass per unit length for axial waves and the moment of inertial per unit length for rotational waves, v the axial velocity for axial waves and the angular velocity for rotational waves, and $\lambda$ is the axial compliance per unit length for axial waves and the rotational compliance per unit length for rotational waves.

External forces act on the system at the tool joints, and at other locations, most notably at the bit, where a bit model of the form:

$$F = -Sd \tag{4}$$

$$d = \frac{v}{\omega}$$

$$T = -Ed^c - Fv + fF$$

is used (T is the torque, F the axial force, d the depth of cut per revolution, v the axial velocity, ω the angular velocity, and c, f, S and E are constants).

If the drillstring is being modelled when off-bottom, the boundary condition at the bit is taken as being "free" (i.e. zero torque, and zero axial force).

At each tool joint, there are forces modelled from fluid drag, and most notably from friction.

The total frictional force contains a component roughly proportional to the normal side force (calculated as the sum of the gravitational force and a geometric force comprising the local tension multiplied by the curvature), and is also a function of the total sliding velocity (the vector sum of the velocities due to rotation and axial motion). There is not strict proportionality as the ratio of the total frictional force to the normal side force, (i.e. the friction coefficient) may be a function of the estimated contact stress, which is itself a function of the normal side force. The friction coefficient is calculated according to the desired model (e.g. Coulomb or Stribeck-type or other). This allows the effect of these models, and other model parameters, on the dynamics of the system to be established.

In the simulation, the frictional force is not allowed to reverse the direction of motion of a tool joint. Thus if the addition of a calculated frictional force becomes sufficient to change the calculated direction of motion, that force is reduced so as to be just enough to prevent any motion.

An additional fluid drag component may be added that is proportional to the difference in velocity between the drillstring motion and the fluid velocity (and does not depend on the normal side force).

The sliding velocity is a vector quantity, and if the friction coefficient is assumed not to depend on the direction of the velocity, only its magnitude, then the frictional force will also act in the same direction, so as to oppose the motion. More generally, different friction coefficients can be used in the axial and rotational directions, and the various parameters required for the calculation of the friction coefficients may differ for the axial and rotational directions. The sliding velocity is then decomposed into components in these two directions, and the frictional forces calculated separately for the two directions. In this case, the direction of the friction force will not in general oppose the direction of motion.

However, for the modelling of off-bottom drillstring rotation, when running into or pulling out of hole, the relatively small axial drillstring velocity compared to the rotational contact velocity means that the exact form of, the variation in friction coefficient with direction has little effect on the qualitative or quantitative simulation results.

FIGS. 3(*a*) to (*f*) show results for a simulation on a 6000 m long drillstring, in which a Coulomb friction model is applied. The borehole is largely horizontal and at time zero the drillstring is at rest and off-bottom. A rotation speed of 60 rpm is then applied at the surface and that surface rotation is maintained for all times after time zero. FIGS. 3(*a*) to (*f*) show plots derived from the model of rotation speed against position along the drillstring at times of respectively 4.5, 9.5, 14.5, 19.5, 24.5 and 29.5 seconds.

The simulation predicts that by about 20 seconds, the off-bottom bit is rotating at about 60 rpm without having undergone any stick-slip oscillations. Effectively, the rotation is stable and uniform along the length of the drillstring.

Next, FIGS. 4(*a*) to (*f*) show results for a corresponding simulation, in which the only change is that a Stribeck-type friction model is applied instead of the Coulomb friction model. Again, FIGS. 4(*a*) to (*f*) show plots derived from the model of rotation speed against position along the drillstring at times of respectively 4.5, 9.5, 14.5, 19.5, 24.5 and 29.5 seconds.

The simulation based on the Stribeck-type friction model does not predict the achievement of stable and uniform rotation along the length of the drillstring. Rather, strong stick-slip oscillations are produced, with the off-bottom bit rotating at one point at over 160 rpm before dropping back down to zero rpm.

Simulations of purely axial motion of horizontal drillstrings show qualitatively similar results. Using a Coulomb friction model and pulling or pushing the drillstring from surface, after a time the drillstring moves in a smooth manner at constant speed. Employing a Stribeck friction model, the drillstring motion is jerky and erratic, with portions of the drillstring in motion when other portions are stationary.

Thus employing either an inverse quadratic or exponential Stribeck-type friction model in such simulations, or more generally employing a friction coefficient which is a varying function of non-zero sliding velocities, can lead to predicted behaviour which is in agreement with field observations. In contrast, the Coulomb friction model provides predictions which are not in agreement. For example, in simulations of initiation of rotation in a drillstring in a high-angle well, the Coulomb friction model cannot reproduce off-bottom rotational oscillations of the type observed in the field.

Further, simulations based on the Stribeck-type friction model show that the occurrence of rotational oscillations depends critically on the start-up rotation speed, the oscillations being worse for longer high-angle drillstring sections, and the oscillations depending on the properties of the drillpipe in the drillstring, most notably the moment of inertia and rotational stiffness, and the ratio of the mass per unit length to the rotational stiffness. For different drillpipe of the same material, key parameters are the mean cross-sectional area of the metal in the pipe, and the mean radius squared of the metal in the pipe.

An interesting feature of the simulations is that only a small change in the simulation parameters can completely alter the predicted behaviour of the drillstring. For example, if the drillstring is brought up to a rotation speed at which no stable rotation can be maintained, only a small increase in rotation speed can move the drillstring into a regime in which the oscillations quickly decay down to steady rotation.

This behaviour can be exploited to calibrate the velocity dependent parameter (i.e. σ or β) in the expression for the friction coefficient. For example, if it is observed in the real well that at 150 rpm there are uncontrollable oscillations and at 165 rpm stable rotation is achieved, then the velocity dependent parameter may be chosen to lie within the narrow range which reproduces this behaviour for the drillstring in question. Having established the velocity parameter, predictions of behaviour in a longer hole, or with a different drillstring may be made.

Other observations may be used in a similar manner. For example, the length of drillstring at which stick-slip oscillations begin can also allow the velocity dependent parameter to be calibrated.

Thus the present invention provides for the first time an approach in which a drillstring/borehole friction coefficient with different values for different non-zero rotational velocities is determined, and then that friction coefficient is subsequently used for forward modelling of the drillstring. The approach can be particularly effective when the determination is based on existing drilling data for that drillstring. Previous determination of Stribeck-type friction coefficients has relied on laboratory testing equipment, as for example in Briscoe et al. (ibid.).

Nonetheless, laboratory measurements can also be used to characterise Stribeck-type friction models, and are particularly useful when real drillstring data are not available, or when confirmation of or extrapolations from measurements based on such data are required. For example, measurements can be made of the friction coefficient between two objects representative of the tubulars in the drillstring and the borehole wall respectively, the objects being immersed in a fluid representative of the drilling fluid used in the well. Changes to the coefficient can then be measured as a function of the relative contact velocity between the objects and any other parameters that may be of interest, such as normal force, relative curvatures of the contacting surfaces of the objects, solids content in the fluid, time in contact, fractional content of lubricants, temperature and pressure.

Figure 5:
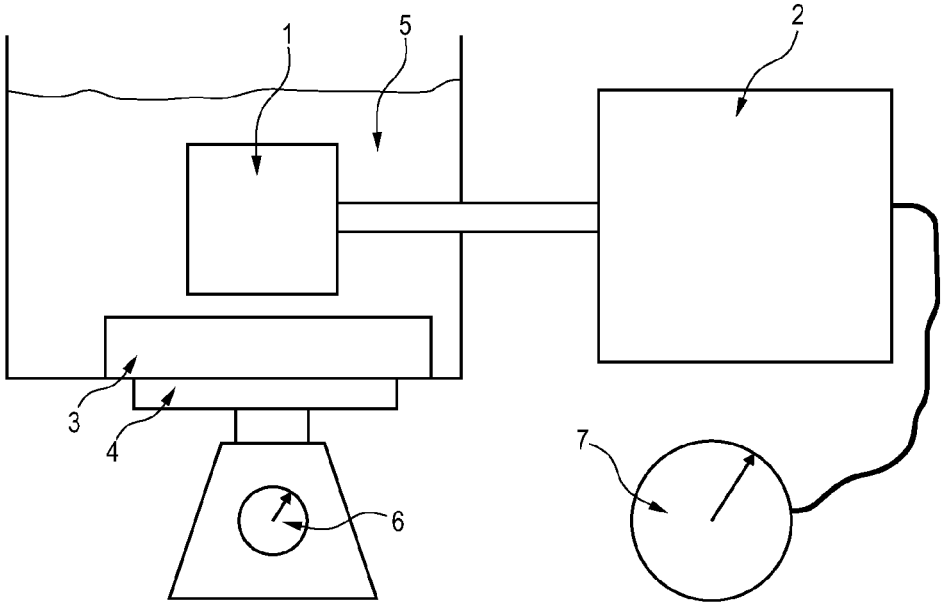
FIG. 5 shows a possible laboratory apparatus for making friction coefficient measurements.

A possible laboratory apparatus for making velocity dependent friction coefficient measurements is shown in FIG. 5. A steel bobbin 1 is rotated at a fixed speed by a motor 2. Pressing up on the bobbin is a material sample 3, the pressing force being supplied by a hydraulic piston 4. The bobbin and material sample are immersed in a fluid bath 5. The force on the sample may be calculated from the reading of a hydraulic pressure gauge 6, and the torque required to turn the bobbin can be determined indirectly from current meter 7 for the motor.

The experimentally determined values of the friction coefficient versus contact pressure and velocity can be used directly in simulations of the rotational behaviour of the drillstring, prior to the drilling of the borehole. Additionally or alternatively, a theoretical Stribeck-type friction coefficient curve (or a range of curves) can be fitted to the laboratory measurements and used in the simulations.

A further use of experimentally determined values of the friction coefficient is to establish initial reasonable ranges for the parameters of a Stribeck-type friction model. The parameters can then be varied within these ranges in simulations of the rotational dynamics of a drillstring to match with the observed dynamics of the drillstring while rotating inside the borehole.

Different lubricants and other additives can also be tested and their effects observed on the variation of the experimentally determined friction coefficient with velocity and other parameters. Again, the friction coefficients can be tested in modelling simulations of the rotational dynamics of a drillstring. Based on the simulations, the additives can be chosen that provide the most stable rotational behaviour, or provide at least adequate rotational behaviour while also providing other desirable characteristics, such as reducing the dynamic friction coefficient when rotating at the speed required to drill-ahead.

Figure 6:
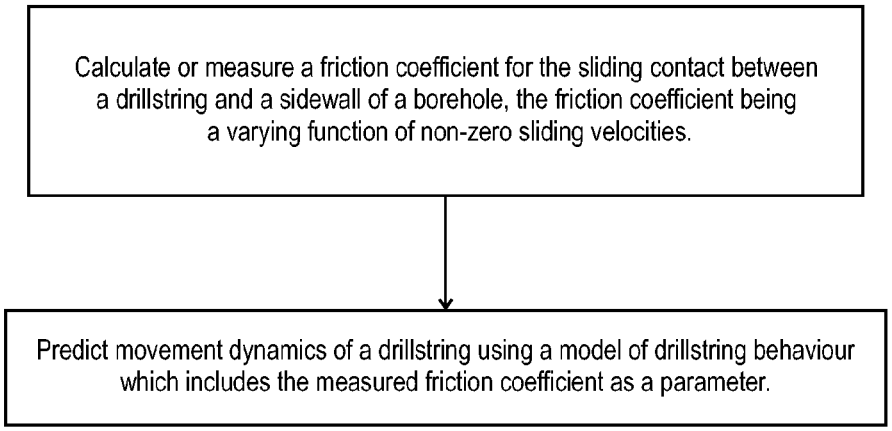
FIG. 6 is a flow chart for a method of determining movement dynamics of a drillstring.
Figure 7:
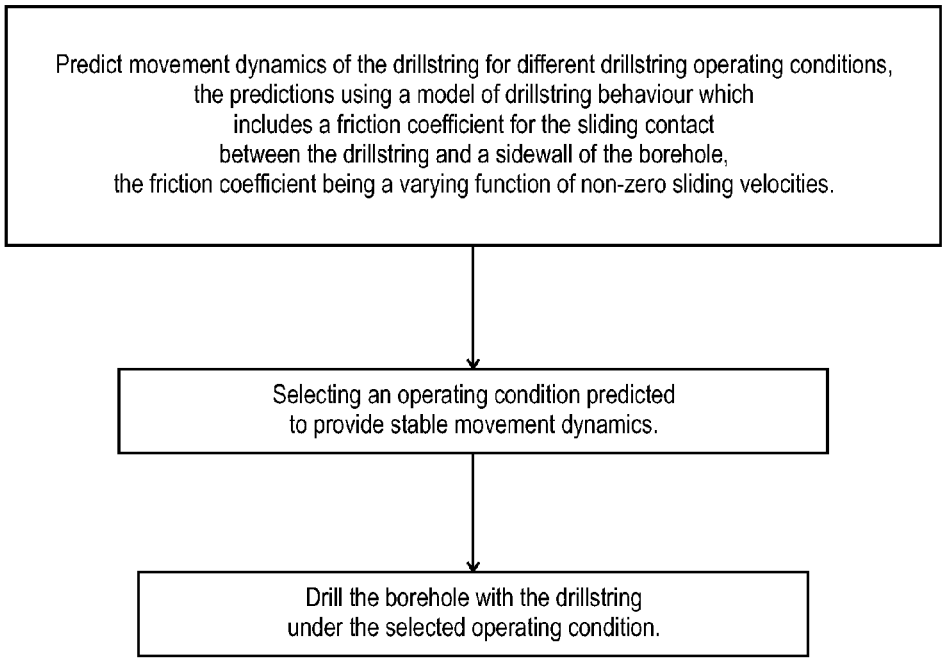
FIG. 7 is a flow chart for a method of operating a drilling rig which controls a drillstring in a borehole.

FIGS. 6 and 7 are flow charts which show schematically methods according to the present invention. FIG. 6 is a flow chart for a method of determining movement dynamics of a drillstring, and FIG. 7 is a flow chart for a method of operating a drilling rig which controls a drillstring in a borehole.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A method of determining movement dynamics of a drillstring in a borehole, comprising the steps of:

(a) calculating or measuring a friction coefficient for a sliding contact between the drillstring and a sidewall of the borehole, wherein the sliding contact comprises a rotational contact between the drillstring and the sidewall, wherein the borehole is a deviated borehole, and wherein frictional force between the drillstring and the deviated borehole includes a component proportional to a side force between the drillstring and the deviated borehole and the friction coefficient comprises a varying function of non-zero sliding velocities; and (b) using a processor to predict movement dynamics and rotational velocity of the drillstring using a model of drillstring behaviour that includes the calculated or measured friction coefficient as a parameter.

2. The method according to claim 1, further comprising providing the predicted movement dynamics to an operator of the drillstring.

3. The method according to claim 1, wherein the operator is a second processor.

4. The method according to claim 1, wherein the friction coefficient is calculated in step (a), the calculation being performed by fitting a model of drillstring behaviour to in-service measurements obtained from the drillstring while the drillstring is operating in the borehole, the model having said friction coefficient as a directly or indirectly adjustable variable.

5. The method according to claim 4, further comprising an initial step of operating the drillstring to obtain the in-service measurements.

6. The method according to claim 1, wherein the friction coefficient is measured in step (a), the measurement being obtained from a test rig which simulates sliding contact between the drillstring and the sidewall of the borehole.

7. The method according to claim 1, including performing step (b) repeatedly for different drillstring operating conditions.

8. The method according to claim 7, wherein the different operating conditions are obtained by varying one or more modelling parameters selected from the group consisting of drillstring advance rate, drillstring length, drillstring trajectory, drillstring rotational velocity, mean cross-sectional area of the metal in the drillstring pipe, and mean radius squared of the metal in the drillstring pipe.

9. The method of operating a drilling rig that controls a drillstring in a borehole, the method comprising:

performing the method of claim 7 to identify an operating condition for the drillstring predicted to provide stable movement dynamics; and drilling the borehole with the drillstring under the identified operating condition.

10. A method of operating a drilling rig which controls a drillstring in a borehole, the method comprising the steps of:

(a) predicting movement dynamics of the drillstring for different drillstring operating conditions, wherein the borehole comprises a deviated borehole and the predictions use a model of drillstring behaviour that includes a friction coefficient for a sliding contact between the drillstring and a sidewall of the deviated borehole, wherein the sliding contact comprises a rotational contact between the drillstring and the sidewall, the friction coefficient being a varying function of non-zero sliding velocities, and wherein friction between the drillstring and the deviated borehole includes a component proportional to a normal side force between the drillstring and the deviated borehole;

(b) selecting an operating condition predicted to provide stable movement dynamics of the drillstring;

(c) drilling the deviated borehole with the drillstring under the selected operating condition.

11. The method according to claim 10, wherein:

in step (a) the different operating conditions are obtained by varying one or more modelling parameters selected from the group consisting of drillstring advance rate, drillstring length, drillstring trajectory, drillstring rotational velocity, mean cross-sectional area of the metal in the drillstring pipe, mean radius squared of the metal in the drillstring pipe and the velocity dependency of the friction coefficient.

12. The method according to claim 11, wherein different velocity dependencies of the friction coefficient correspond to different drilling fluids.

13. The method according to claim 12, wherein the method further includes the initial step of measuring said velocity dependencies for different drilling fluids, in step (a) the different operating conditions are obtained by varying at least the velocity dependency of the friction coefficient according to the velocity dependencies measured for the drilling fluids, and in step (c) the borehole is drilled with the drilling fluid corresponding to the selected operating condition.

14. The method according to claim 10, wherein the movement dynamics include the drillstring rotational velocity.

15. The method according to claim 10, wherein the friction coefficient is a smoothly varying function of non-zero sliding velocities.

16. The method according to claim 10, wherein the friction coefficient decreases with increasing sliding velocity for at least a range of non-zero sliding velocities.

* * * * *